US008346155B2

(12) United States Patent
Iwata

(10) Patent No.: US 8,346,155 B2
(45) Date of Patent: Jan. 1, 2013

(54) SHEET PROCESSING APPARATUS HAVING PUNCH UNIT, AND IMAGE FORMING APPARATUS

(75) Inventor: Toshiyuki Iwata, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 363 days.

(21) Appl. No.: 12/695,965

(22) Filed: Jan. 28, 2010

(65) Prior Publication Data

US 2010/0189487 A1 Jul. 29, 2010

(30) Foreign Application Priority Data

Jan. 29, 2009 (JP) ..... 2009-018821
Dec. 16, 2009 (JP) ..... 2009-284855

(51) Int. Cl.

| | |
|---|---|
| ***G03G 15/00*** | (2006.01) |
| ***B65H 7/02*** | (2006.01) |
| ***B65H 33/04*** | (2006.01) |
| ***B65H 39/00*** | (2006.01) |

(52) U.S. Cl. ..... 399/407; 271/227; 271/252; 270/58.07

(58) Field of Classification Search ..... 399/405, 399/407, 408, 410; 271/228, 248–250, 252; 270/58.01, 58.02, 58.07

See application file for complete search history.

(56) References Cited

U.S. PATENT DOCUMENTS

| | | | | |
|---|---|---|---|---|
| 7,392,983 | B2 * | 7/2008 | Kodama et al. | 271/249 |
| 7,546,081 | B2 * | 6/2009 | Tokita et al. | 399/407 |
| 8,042,796 | B2 * | 10/2011 | Iguchi | 270/58.07 |
| 2006/0120783 | A1 | 6/2006 | Tokita | |

FOREIGN PATENT DOCUMENTS

| | | |
|---|---|---|
| JP | 2006-347678 | 12/2006 |

* cited by examiner

*Primary Examiner* — Judy Nguyen
*Assistant Examiner* — Justin Olamit
(74) *Attorney, Agent, or Firm* — Canon USA Inc. IP Division

(57) ABSTRACT

After a sheet has once passed through a punching position where punching processing is performed, a conveyance roller pair conveys the sheet backward to the punching position. A lateral registration detection sensor detects a side edge position of the sheet in a width direction. When a sheet processing apparatus corrects the side edge position of the sheet by controlling a shift unit configured to move the sheet in the width direction so as to correct the side edge position of the sheet, the sheet processing apparatus sets a shifting amount of the sheet to a value that is a predetermined amount greater than a shifting amount required to correct the side edge position of the sheet according to the side edge position of the sheet detected by the lateral registration detection sensor. After the sheet has passed through the die hole in the backward movement toward the punching position, the sheet processing apparatus sets the shifting amount to the required value.

9 Claims, 16 Drawing Sheets

SHEET PROCESSING APPARATUS HAVING PUNCH UNIT, AND IMAGE FORMING APPARATUS

BACKGROUND OF THE INVENTION

1. Field of the Invention

The present invention relates to a sheet processing apparatus and an image forming apparatus. More specifically, the present invention relates to a sheet processing apparatus and an image forming apparatus that include a punching unit configured to perform punching processing on a sheet.

2. Description of the Related Art

A conventional image forming apparatus, such as a copying machine, a laser beam printer, a facsimile machine, or a multifunction peripheral, may be equipped with a sheet processing apparatus that can perform binding processing for binding sheets on which images are formed (printed) and then perform punching processing for opening punch holes in the sheets being bound.

FIG. 15 illustrates a configuration of a conventional sheet processing apparatus 2400 that performs the above-described punching processing. The sheet processing apparatus 2400 includes a punch unit 2320 configured to perform punching processing, a lateral registration detection unit 2330 configured to detect the position of an edge portion of a sheet in the width direction perpendicular to a sheet conveyance direction, and a shift unit 2340 configured to move the sheet in the width direction. The punch unit 2320 illustrated in FIG. 15 includes a punch guide, a die, and a conveyance guide.

When the sheet processing apparatus 2400 performs punching processing on a sheet, the lateral registration detection unit 2330 detects an edge portion of the sheet in the width direction while the sheet is conveyed. Then, the shift unit 2340 moves the sheet to a position corresponding to a predetermined punching position based on edge portion information obtained by the lateral registration detection unit 2330.

Next, the shift unit 2340 stops the sheet when the position of the sheet coincides with the predetermined punching position. Then, the sheet processing apparatus 2400 causes the sheet to switch back. An upstream edge of the sheet in the sheet conveyance direction abuts a rear edge stopper 2221. In other words, the sheet processing apparatus 2400 corrects a skew of the sheet. Finally, the sheet processing apparatus 2400 performs punching processing on the skew-corrected sheet.

A conventional sheet processing apparatus discussed in Japanese Patent Application Laid-Open No. 2006-347678 is equipped with a punch unit that can form two-hole type punch holes or three-hole type punch holes at predetermined intervals, respectively, according to a sheet size. When a user sets a sheet size via an operation unit, the above-described sheet processing apparatus selects an operational state of the punch unit according to the input sheet size between a state where the punch unit can form the two-hole type punch holes and a state where the punch unit can form the three-hole type punch holes.

FIG. 16 illustrates a die 2200 that can be used for the punch unit configured to selectively form the two-hole type punch holes and the three-hole type punch holes according to a switching of the above-described operational state. The two-hole type punch holes and the three-hole type punch holes, which can be formed using the die 2200, are mutually different in interval between the holes to be formed and total number of the holes to be formed. The die 2200 includes a pair of die hole portions 2218*b* and 2218*d* dedicated to formation of the two-hole type punch holes. The die 2200 further includes three die hole portions 2218*a*, 2218*c*, and 2218*e* dedicated to formation of the three-hole type punch holes.

However, in the above-described conventional sheet processing apparatus or in an image forming apparatus associated with the above-described conventional sheet processing apparatus, the sheet processing apparatus opens the two-hole type punch holes in a sheet if the sheet is a small-size sheet (e.g., LTR_R or LGL).

When the sheet processing apparatus opens the two-hole type punch holes in the above-described small-size sheet, as illustrated in FIG. 16, the sheet processing apparatus once stops a conveyed sheet P at a sheet stop position. Then, the sheet processing apparatus corrects a side edge position of the sheet P in the width direction perpendicular to the sheet conveyance direction. Then, the sheet processing apparatus causes the sheet P to switchback and abut the rear edge stopper 2221.

However, when the sheet processing apparatus causes the sheet P to switch back, a rear edge corner portion Pg of the sheet P may interfere with the three-hole type die hole portion 2218*a* (2218*e*) at the sheet stop position. More specifically, the sheet P causing a switchback motion may be hooked by the three-hole type die hole portion 2218*a* (2218*e*). In this case, the switchback operation of the sheet P cannot be performed smoothly and the position accuracy in the formation of the punch holes deteriorates significantly.

SUMMARY OF THE INVENTION

An exemplary embodiment of the present invention is directed to a sheet processing apparatus and a related image forming apparatus, which can improve the position accuracy in the formation of punch holes.

According to an aspect of the present invention, a sheet processing apparatus includes a sheet conveyance unit configured to convey a sheet, a punching unit including a plurality of punches disposed in a width direction perpendicular to a sheet conveyance direction and die holes that are cooperative with the plurality of punches to perform punching processing on the sheet, and a shifting unit configured to move the sheet in the width direction. If a corner portion of the sheet being conveyed by the sheet conveyance portion is in an overlapped relationship with the die hole, the shifting unit moves the conveyed sheet in the width direction by a predetermined amount that is set beforehand.

The sheet processing apparatus according to the present invention shifts the conveyed sheet in the width direction by the predetermined amount, so as to prevent a side edge position of the conveyed sheet from being positioned in an overlapped relationship with the die hole. After a downstream edge of the sheet in the sheet conveyance direction has passed through the die hole, the sheet processing apparatus moves the sheet backward in the width direction by the predetermined amount. Therefore, the sheet processing apparatus according to the present invention can prevent a rear edge corner portion of the sheet from interfering with (being hooked by) the die hole.

Further, in an operation for correcting the side edge position of the conveyed sheet, the sheet processing apparatus sets a shifting amount of the sheet to a value that is greater than a shifting amount required for the correction by a predetermined amount.

After the sheet being conveyed to a punching position has passed through the hole, the sheet processing apparatus adjusts the shifting amount of the sheet to the required shifting amount. Therefore, the sheet processing apparatus according to the present invention can improve the position accuracy in the formation of punch holes.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
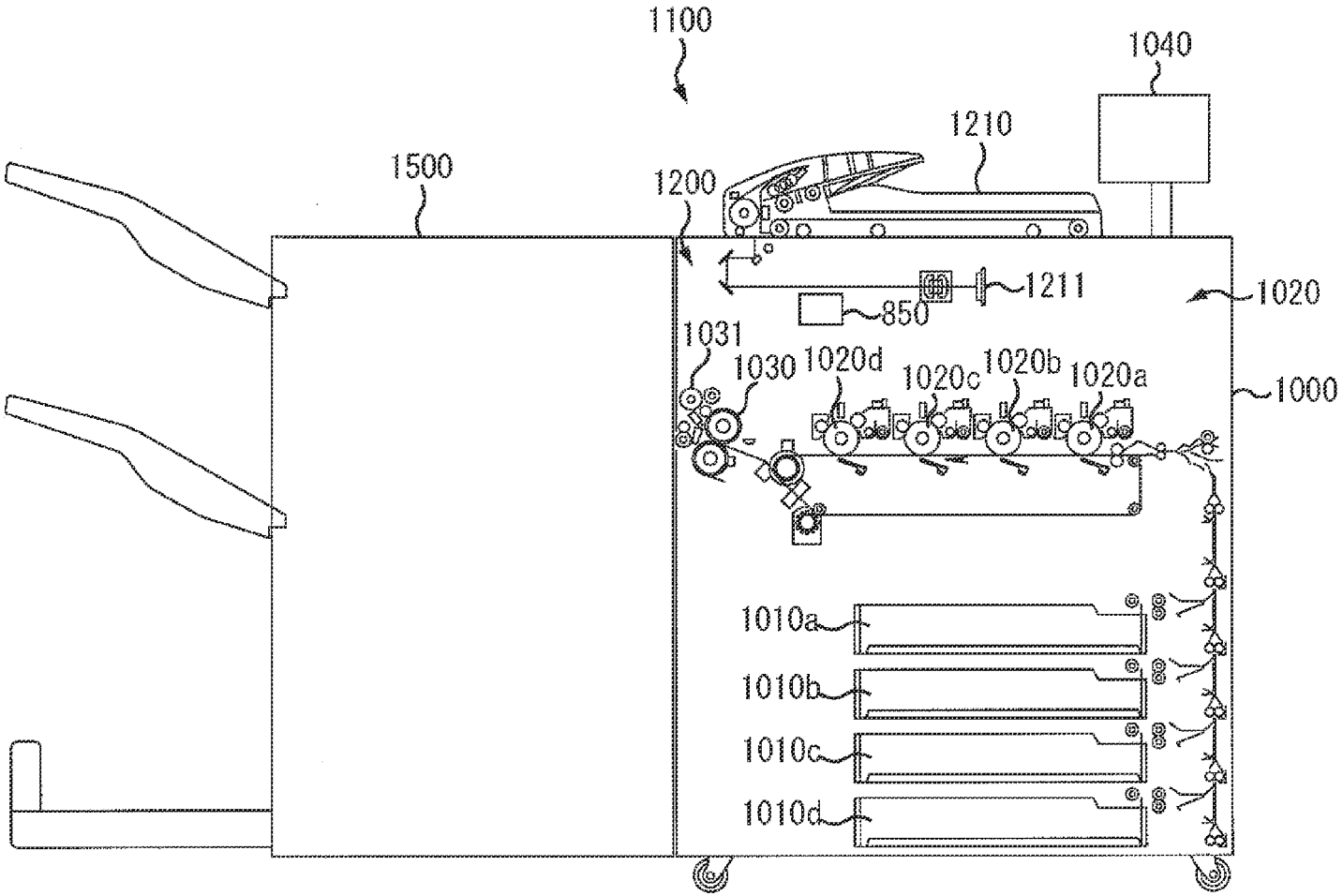
FIG. 1 illustrates a configuration of a monochrome/color copying machine that is an example of an image forming apparatus associated with a sheet processing apparatus according to an exemplary embodiment of the present invention.

FIG. 1 illustrates a configuration of a monochrome/color copying machine 1100 that is an example of an image forming apparatus associated with a sheet processing apparatus according to an exemplary embodiment of the present invention.

The monochrome/color copying machine 1100 (hereinafter, simply referred to as a copying machine) illustrated in FIG. 1 includes a copying machine main body 1000 and a finisher 1500. The finisher 1500, which can serve as the sheet processing apparatus, is connected to a side of the copying machine main body 1000. The copying machine 1100 further includes a document reading portion (i.e., an image reader) 1200 provided in the upper portion of the copying machine main body 1000 and a document conveyance apparatus 1210 that can convey a document sheet to automatically read a plurality of document sheets.

The copying machine main body 1000 includes a plurality of sheet feeding cassettes 1010*a* to 1010*d* each having a predetermined storage capacity for storing numerous sheets (e.g., papers) to be used for image forming processing, an image forming portion 1020 that can form a toner image on a sheet according to electro-photographic processes, and a fixing device 1030 that can fix the toner image formed on the sheet.

An operation portion 1040, provided on an upper surface of the copying machine main body 1000, enables users to perform various input/setting operations for the copying machine main body 1000. A central processing unit (CPU) circuit unit 850 is a control unit configured to control various operations to be performed by the copying machine main body 1000 and the finisher 1500.

When the above-described copying machine 1100 forms an image of a document (not illustrated) on a sheet, the document conveyance apparatus 1210 conveys a document and an image sensor 1211 provided in the document reading portion 1200 reads an image of the document conveyed by the document conveyance apparatus 1210. Then, the image forming portion 1020 irradiates photosensitive drums 1020*a* to 1020*d* provided therein with laser beams based on digital data read by the image sensor 1211 to form an electrostatic latent image on the surface of each photosensitive drum.

The image forming portion 1020 then develops the electrostatic latent images formed on the surfaces of respective photosensitive drums 1020*a* to 1020*d* to form toner images of yellow, magenta, cyan, and black on the surfaces of respective photosensitive drums 1020*a* to 1020*d*.

In accordance with the above-described toner image forming operation, the copying machine main body 1000 feeds a sheet from the sheet feeding cassette 1010 provided in the copying machine main body 1000 to the image forming portion 1020. Then, the copying machine main body 1000 transfers the four-color toner images formed on the yellow, magenta, cyan, and black photosensitive drums 1020*a* to 1020*d* onto the sheet fed from the sheet feeding cassette 1010. The copying machine main body 1000 further conveys the sheet to the fixing device 1030.

Next, the fixing device 1030 permanently fixes the transferred images. A discharge roller pair 1031 discharges the sheet on which the image is fixed from the copying machine main body 1000 and conveys the discharged sheet to the finisher 1500.

The finisher 1500 successively receives sheets discharged from the copying machine main body 1000 and performs processing for aligning and bundling a plurality of received sheets. The finisher 1500 includes a punch unit 1320 that can perform punch processing for opening punch holes along a rear edge of each sheet. The finisher 1500 further includes a flat binding processing apparatus 1300. The flat binding processing apparatus 1300 includes a stapler 1310 that performs staple processing for binding the rear edge (i.e., an upstream edge in the sheet conveyance direction) of the sheet bundle. The finisher 1500 performs various processing including sort/non-sort processing and two-folding bookbinding processing.

In the present exemplary embodiment, the finisher 1500 is an on-line sheet processing apparatus capable of performing various processing on each sheet discharged from the copying machine main body 1000. The finisher 1500 may be used as an optional sheet processing apparatus. Therefore, the copying machine main body 1000 can be used as an independent apparatus. Alternatively, the finisher 1500 and the copying machine main body 1000 can be integrated as a single apparatus.

Figure 2:
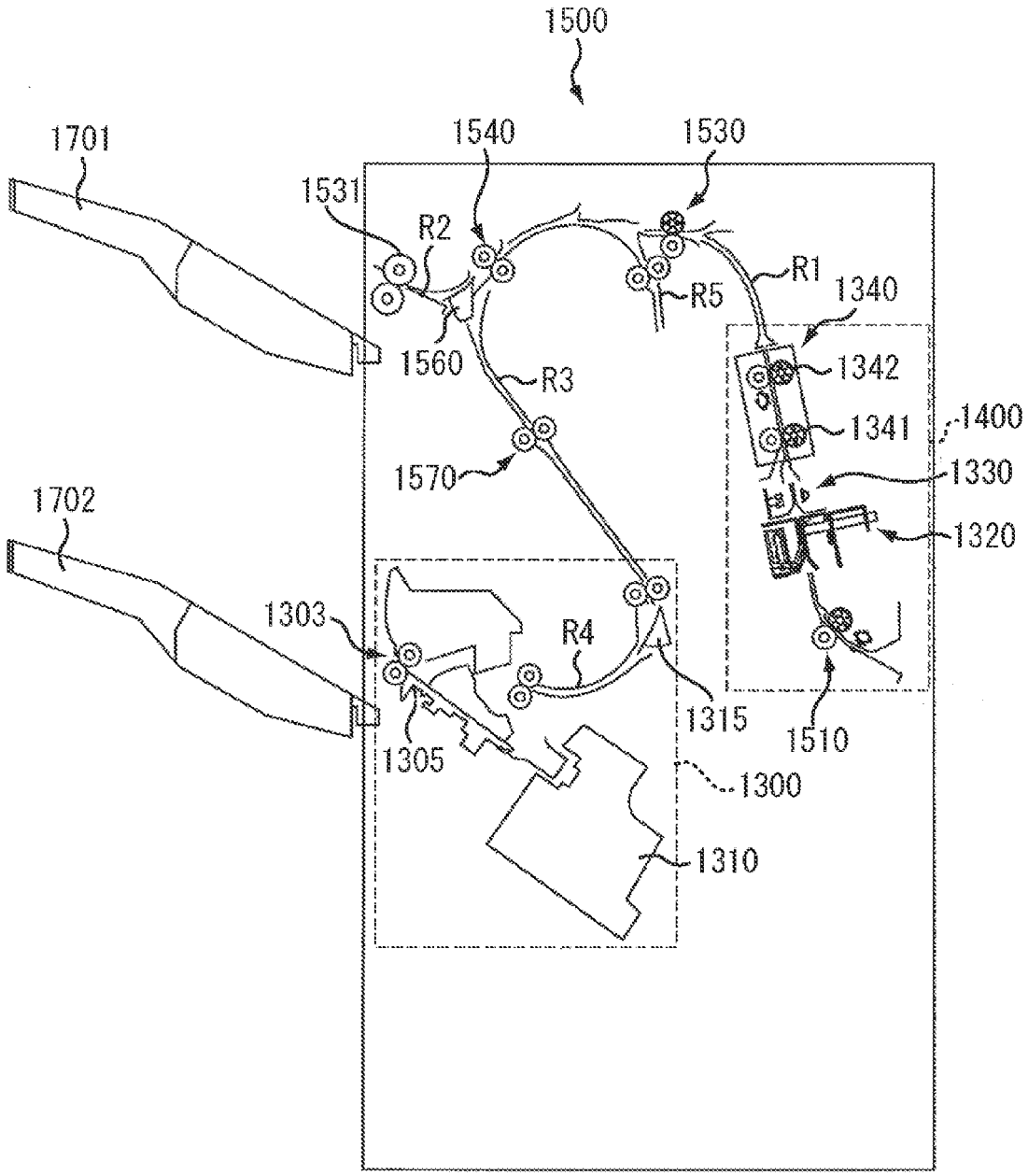
FIG. 2 is a configuration of a finisher that can serve as the sheet processing apparatus associated with the image forming apparatus illustrated in FIG. 1.

The finisher 1500, as illustrated in FIG. 2, includes a conveyance path R1 that receives each sheet discharged from the copying machine main body 1000 to an inside space of the finisher 1500. An inlet roller pair 1510 and a conveyance roller pair 1530 are provided on the conveyance path R1. Then, a sheet punching processing apparatus 1400 is provided on the downstream side of the inlet roller pair 1510. The sheet punching processing apparatus 1400 is operable in a sheet punching processing operation.

The sheet punching processing apparatus 1400 can perform boring (punching) processing, if necessary, for opening holes along the upstream edge portion of a conveyed sheet in sheet conveyance direction.

A buffer roller 1540 is provided on the downstream side of the sheet punching processing apparatus 1400. The buffer roller 1540 can rotate in both forward and backward directions. The buffer roller 1540 can be used to control a switchback motion of each sheet conveyed by the conveyance roller pair 1530. A switchback conveyance path R5 has a storage space capable of storing a predetermined number of sheets, which are conveyed by the buffer roller 1540 and stacked there.

A switching member 1560 is disposed on the downstream side of the buffer roller 1540. The switching member 1560 can switch the sheet conveyance path between an upper discharge path R2 and a lower discharge path R3. Then, according to the switching operation of the switching member 1560, each sheet having arrived at the buffer roller 1540 or the predetermined number of sheets stacked in the switchback conveyance path R5 by the switchback control of the buffer roller 1540 can be selectively conveyed to the upper discharge path R2 or the lower discharge path R3.

An upper discharge roller 1531 can discharge a sheet that is conveyed along the upper discharge path R2 to an upper discharged sheet tray 1701. A sheet being conveyed along the lower discharge path R3 is subsequently conveyed to a lower discharge path R4 or a saddle discharge path (not illustrated) via a switching member 1315. The switching member 1315 can switch the sheet conveyance path between the lower discharge path R4 and the saddle discharge path.

Sheets being conveyed along the lower discharge path R4 are successively discharged to a processing tray 1305. On the processing tray 1305, the sheets are aligned and assembled together as a sheet bundle. Then, the sheet bungle is subjected to various processing (e.g., sorting processing and staple processing) according to the settings input via the operation portion 1040 (see FIG. 1) provided on the copying machine main body 1000. A bundle discharge roller pair 1303 discharges the sheet bundle to a lower discharged sheet tray 1702. The stapler 1310 performs the staple processing. The stapler 1310 can move in the width direction to staple a corner portion or a spine portion of each sheet bundle.

The sheet punching processing apparatus 1400 includes the punch unit 1320 that performs processing for punching a sheet, a lateral registration detection unit 1330 that can detect a side edge position of a sheet in a width direction perpendicular to the sheet conveyance direction, and a shift unit 1340 that can move the sheet in the width direction.

Figure 3:
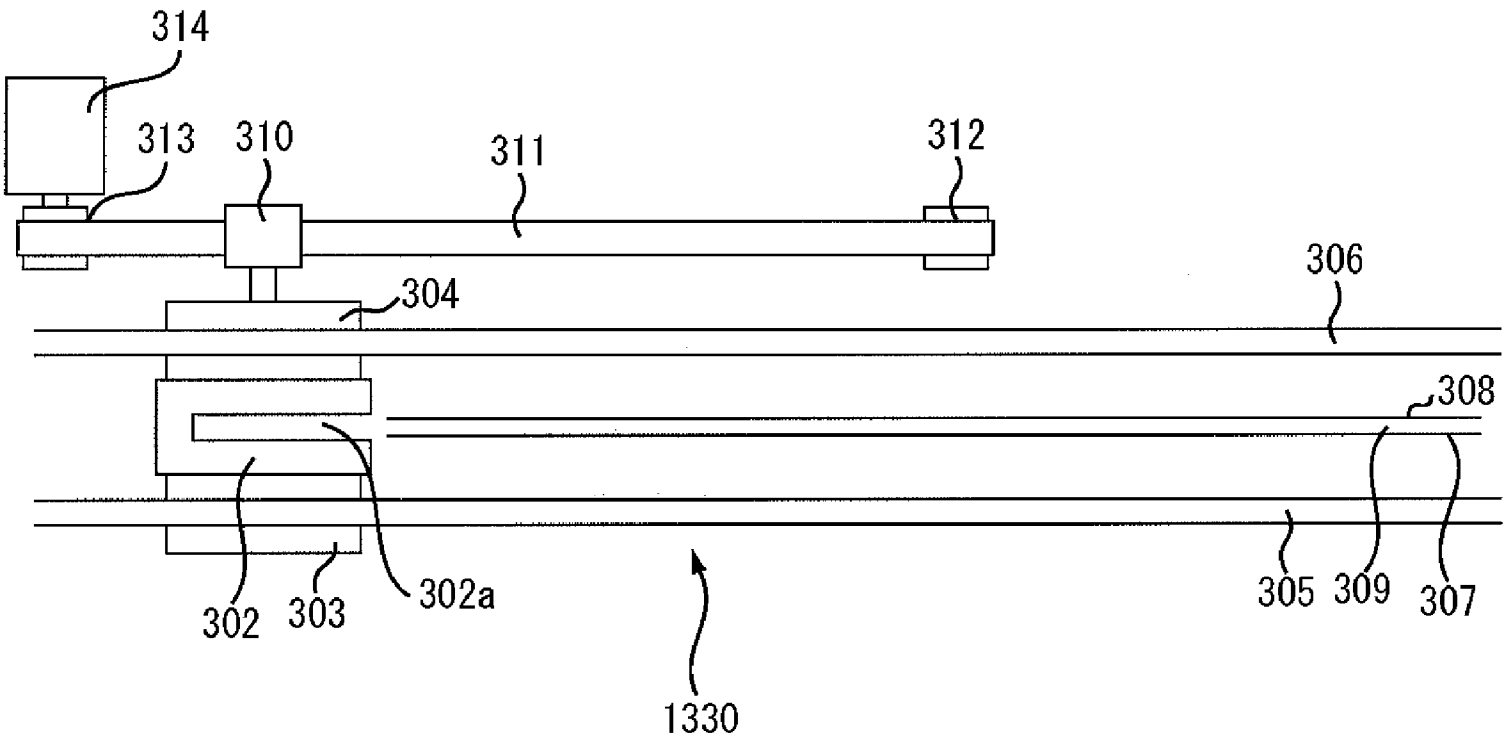
FIG. 3 illustrates a configuration of a lateral registration detection unit of a punching processing apparatus provided in the finisher illustrated in FIG. 2.

The lateral registration detection unit 1330, as illustrated in FIG. 3, includes a lateral registration detection sensor 302 that is a detection unit configured to detect a side edge position of a sheet in the width direction when the sheet moves in a conveyance path 309. The conveyance path 309 is a groove defined by a lower conveyance guide 307 and an upper conveyance guide 308. When a sheet moves in the conveyance path 309, the lateral registration detection sensor 302 detects an edge portion of the sheet in the width direction. Thus, the lateral registration detection unit 1330 can specify the position of the sheet in the width direction.

The lateral registration detection sensor 302 includes two bearings 303 and 304. The lateral registration detection sensor 302 engages, via the bearings 303 and 304, with guides 305 and 306 fixed to the finisher 1500. The lateral registration detection sensor 302 can move along the guides 305 and 306. Further, the lateral registration detection sensor 302 is fixed via a fixing plate 310 to an endless timing belt 311 that is stretched around a pulley 313 of a sensor motor 314 and a pulley 312*a* fixed to the finisher 1500.

Figure 11:
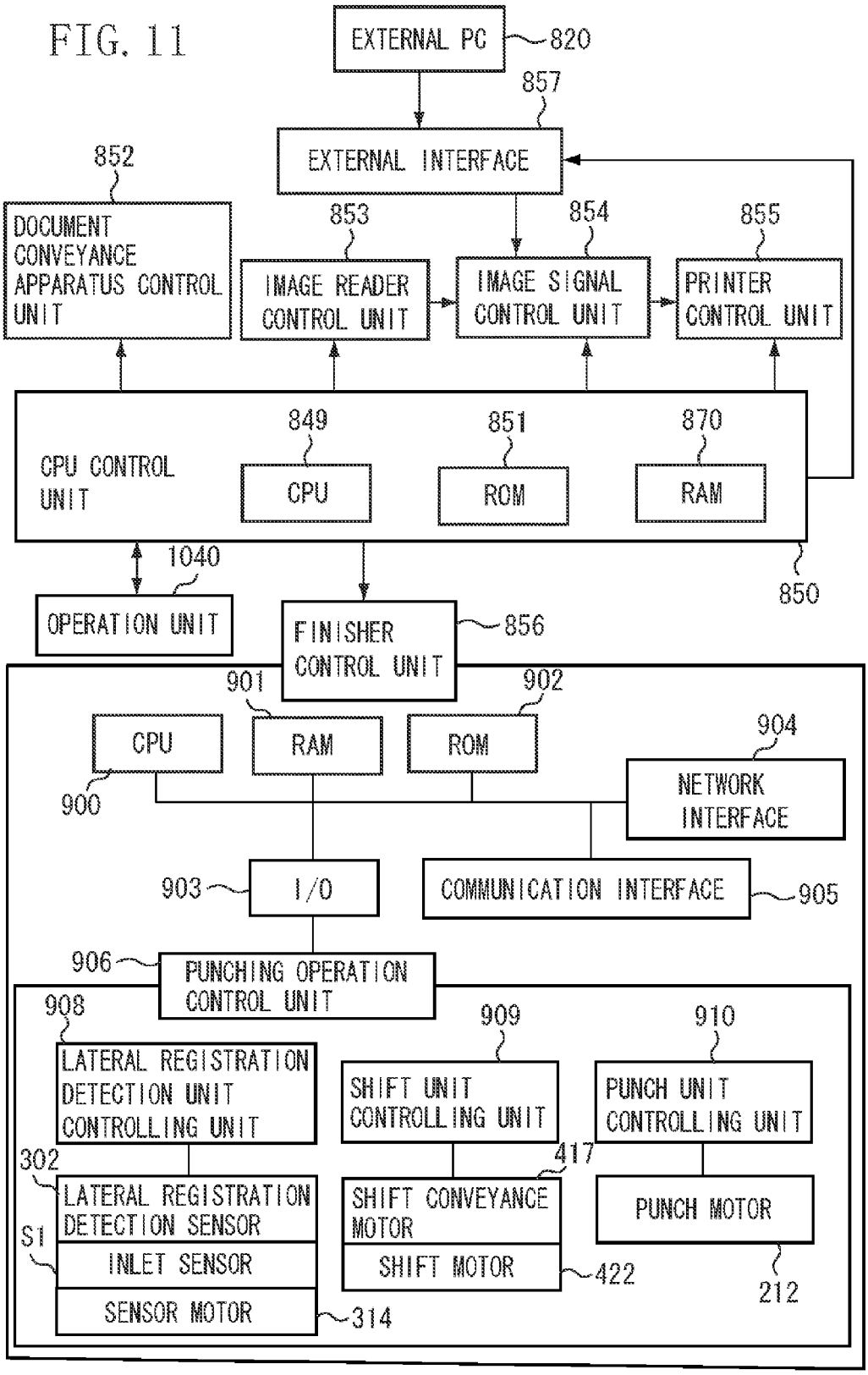
FIG. 11 is a block diagram illustrating a control system of the copying machine illustrated in FIG. 1.

If a user inputs sheet size information via the operation portion 1040 provided on the copying machine main body 1000, a finisher control portion 856 illustrated in FIG. 11 drives the sensor motor 314 based on the input sheet size information. When the finisher control portion 856 starts driving the sensor motor 314, the endless timing belt 311 rotates in a predetermined direction until the lateral registration detection sensor 302 reaches a position corresponding to a sheet size beforehand.

The lateral registration detection sensor 302 includes a recessed portion 302*a* that can be used to detect one side edge portion of a conveyed sheet. More specifically, in a state where one side edge portion of a conveyed sheet is held in the recessed portion 302*a*, the lateral registration detection sensor 302 detects the position of the side edge of the conveyed sheet.

Figure 4:
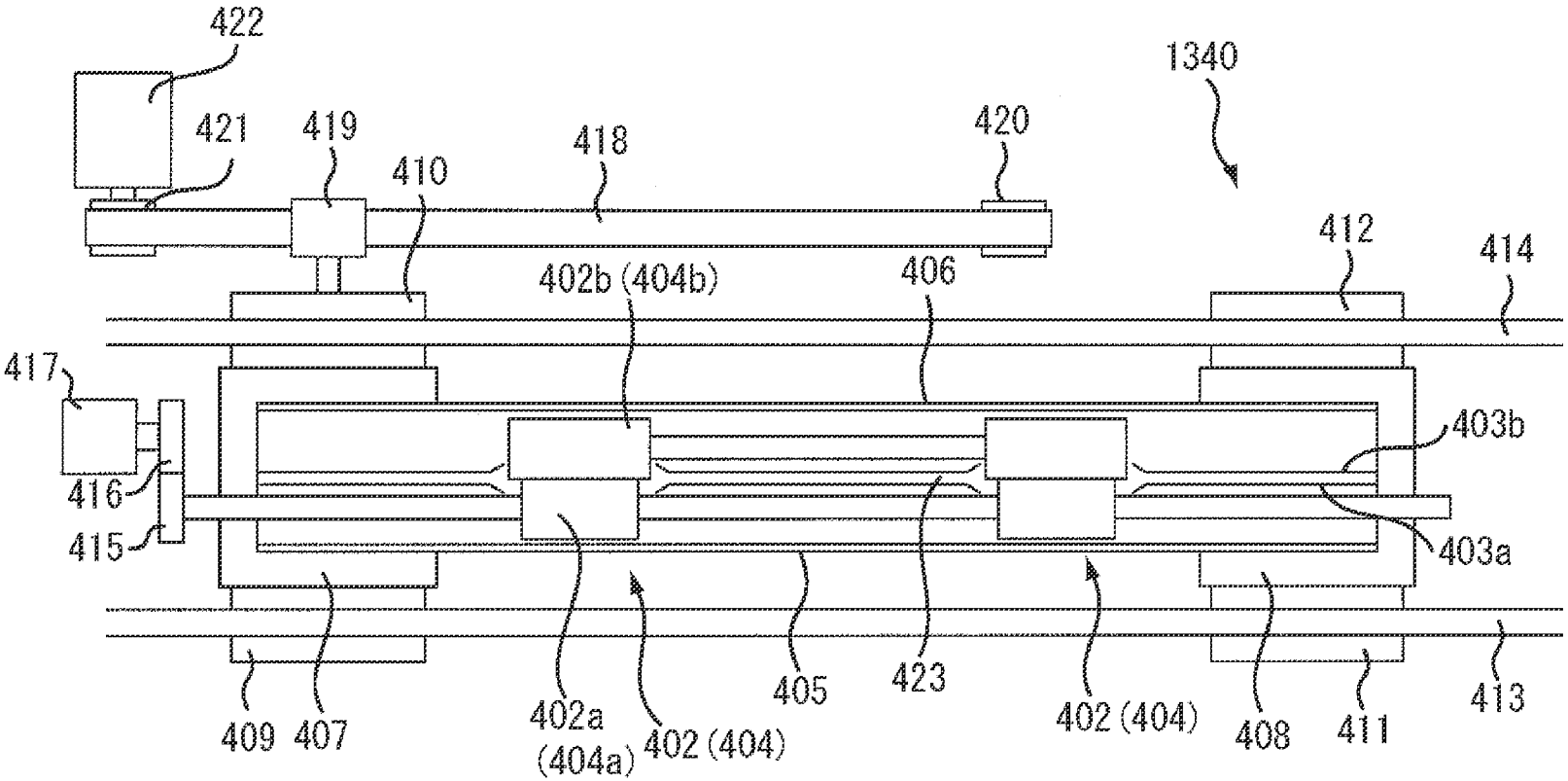
FIG. 4 illustrates a configuration of a shift unit of the punching processing apparatus provided in the finisher illustrated in FIG. 2.

The shift unit 1340 is a shifting unit configured to shift a sheet in the width direction so as to correct a side edge position of the sheet. The shift unit 1340, as illustrated in FIG. 4, includes a conveyance path 423 defined by a lower conveyance guide 403*a* and an upper conveyance guide 403*b*. A conveyance roller pair 402 (404), which is constituted by a lower conveyance roller 402*a* (404*a*) and an upper conveyance roller 402*b* (404*b*), is provided in the conveyance path 423.

The conveyance roller pair 402 (404), more specifically the lower conveyance roller 402*a* (404*a*), is connected via gears 415 and 416 to a shift conveyance motor 417. The shift conveyance motor 417 can rotate in both forward and backward directions. Therefore, the conveyance roller pair 402 (404) can rotate in both forward and backward directions in accordance with the rotation of the shift conveyance motor 417.

The conveyance roller pair 402 (404) constitutes a sheet conveyance portion that can convey a sheet until an upstream edge of the sheet in the sheet conveyance direction once passes through a below-described die hole and then moves the sheet backward to a position where the sheet covers the die hole.

In the present exemplary embodiment, the conveyance roller pair 402 (404) and the conveyance guides 403*a* and 403*b* are supported by frames 405 to 408. The conveyance roller pair 402 (404) and the conveyance guides 403*a* and 403*b* are supported via bearings 409 to 412 by parallel guides 413 and 414 fixed to the finisher 1500. The bearings 409 to 412 are fixed to the frames 405 to 408. The conveyance roller pair 402 (404) and the conveyance guides 403*a* and 403*b* can integrally move along the guides 413 and 414 fixed to the finisher 1500.

The frames 405 to 408 are fixed via a fixing plate 419 to an endless timing belt 418. The endless timing belt 418 is stretched around a pulley 421 of a shift motor 422 and a pulley 420 fixed to the finisher 1500.

Figure 5:
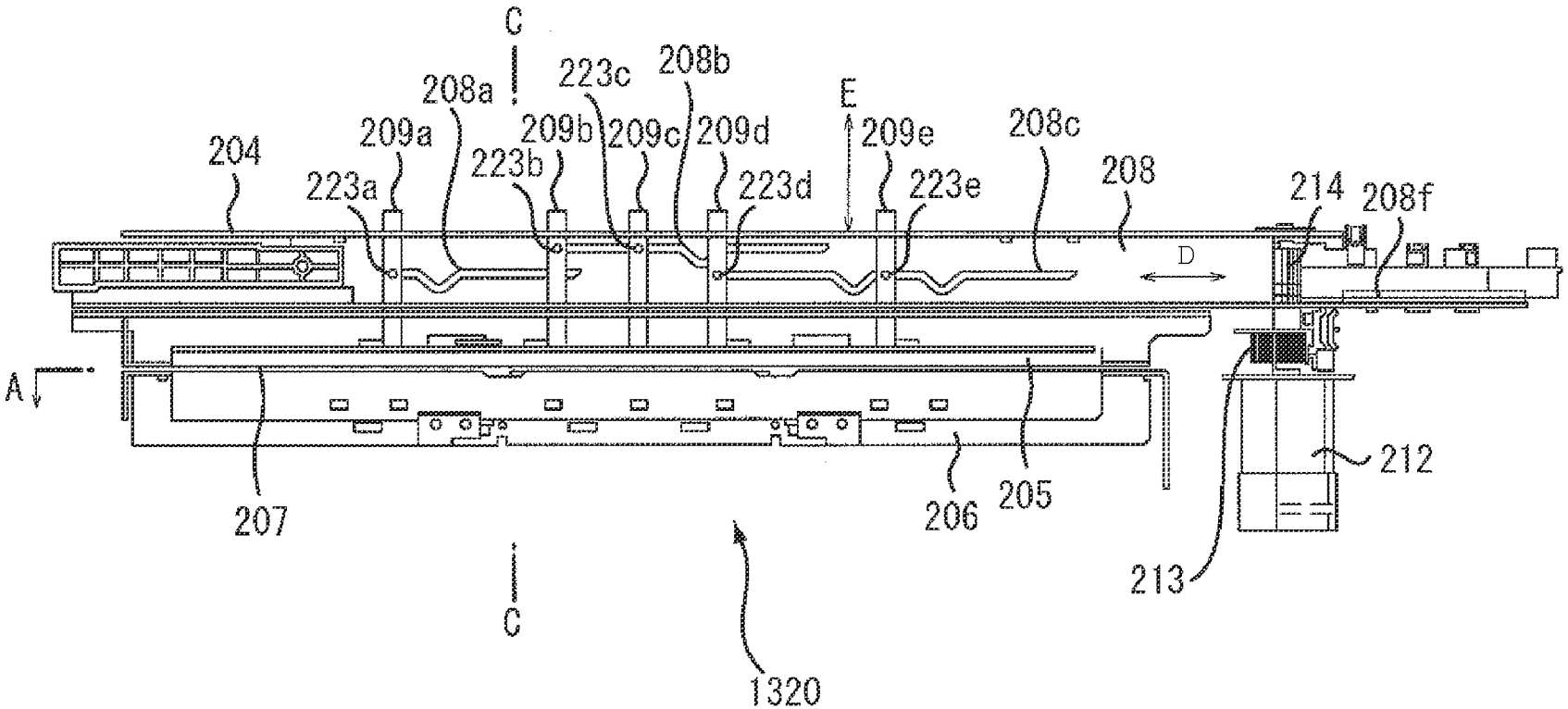
FIG. 5 illustrates a configuration of a punch unit of the punching processing apparatus provided in the finisher illustrated in FIG. 2.

The punch unit 1320, as illustrated in FIG. 5, includes a punch guide 204, a conveyance guide 205 serving as a sheet conveyance guide and fixed to the punch guide 204 by caulking, and a die 206 fixed to the conveyance guide 205 by caulking. A conveyance path 207, which can serve as a sheet conveyance path, is formed between the conveyance guide 205 and the die 206.

The punch guide 204 is equipped with a plurality of punches 209*a* to 209*e*, which are cooperative with the die 206 to serve as a punching unit configured to perform punching processing on a sheet. The plurality of punches 209*a* to 209*e* are disposed at predetermined intervals in the width direction perpendicular to the sheet conveyance direction, so that respective punches 209*a* to 209*e* can protrude toward the die 206.

The plurality of punches 209*a* to 209*e* can selectively form two-hole type punch holes and three-hole type punch holes according to a type of punch holes to be formed. The two-hole type punch holes and the three-hole type punch holes, which can be formed by the plurality of punches 209*a* to 209*e*, are mutually different in interval between the holes to be formed and total number of the holes to be formed.

Figure 6:
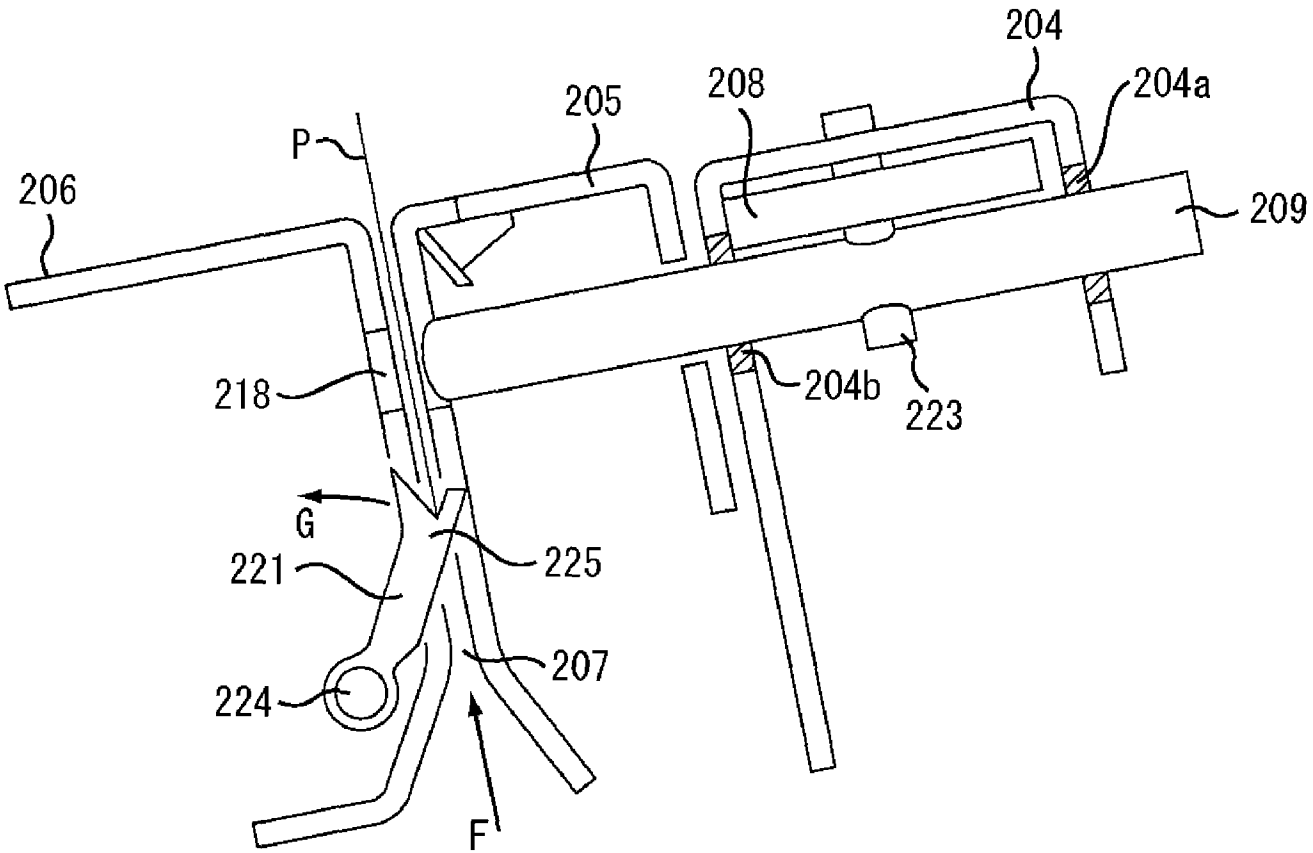
FIG. 6 illustrates a cross-sectional view of the punch unit taken along a line C-C illustrated in FIG. 5.

A slide rack 208 is provided so as to be movable in a direction indicated by an arrow D. The punch guide 204, as illustrated in FIG. 6, includes slide supporting portions 204*a* and 204*b* that support the punch 209 so that the punch 209 can slide relative to the punch guide 204. Further, parallel pins 223*a* to 223*e* are fixed to the punches 209*a* to 209*e*, respectively, as illustrated in FIG. 5.

Further, as illustrated in FIG. 5, cam grooves 208*a* to 208*c* are formed on the slide rack 208. Each of the cam grooves 208*a* to 208*c* extends in a direction along which the slide rack 208 can slide. One edge portion of the parallel pin 223*a* of the punch 209 engages with the corresponding cam groove 208*a*.

Two parallel pins 223*b* and 223*c* are engaged, at one edge portion thereof, with the cam groove 208*b*. Similarly, two parallel pins 223*d* and 223*e* are engaged with the cam groove 208*c*. The slide rack 208 can be driven by a punch motor 212 via gears 213 and 214 and a rack portion 208*f* provided at one edge portion of the slide rack 208. The punch motor 212 can rotate in both forward and backward directions. Thus, the slide rack 208 performs forward and backward slide operations in the direction indicated by the arrow D.

When the slide rack 208 moves in the direction indicated by the arrow D, the plurality of punches 209*a* to 209*e* respectively cause an up-and-down motion in a direction indicated by an arrow E while the parallel pins 223*a* to 223*e* fixed to respective punches 209*a* to 209*e* are guided by the corresponding cam grooves 208*a* to 208*c*. If the user inputs sheet size information via the operation portion 1040 illustrated in FIG. 1, the finisher control portion 856 illustrated in FIG. 11 drives the punch motor 212 according to the input sheet size information.

Thus, the slide rack 208 can selectively move between a first position where the punch unit 1320 can perform a punching operation for opening the two-hole type punch holes and a second position where the punch unit 1320 can perform a punching operation for opening the three-hole type punch holes.

Figure 7:
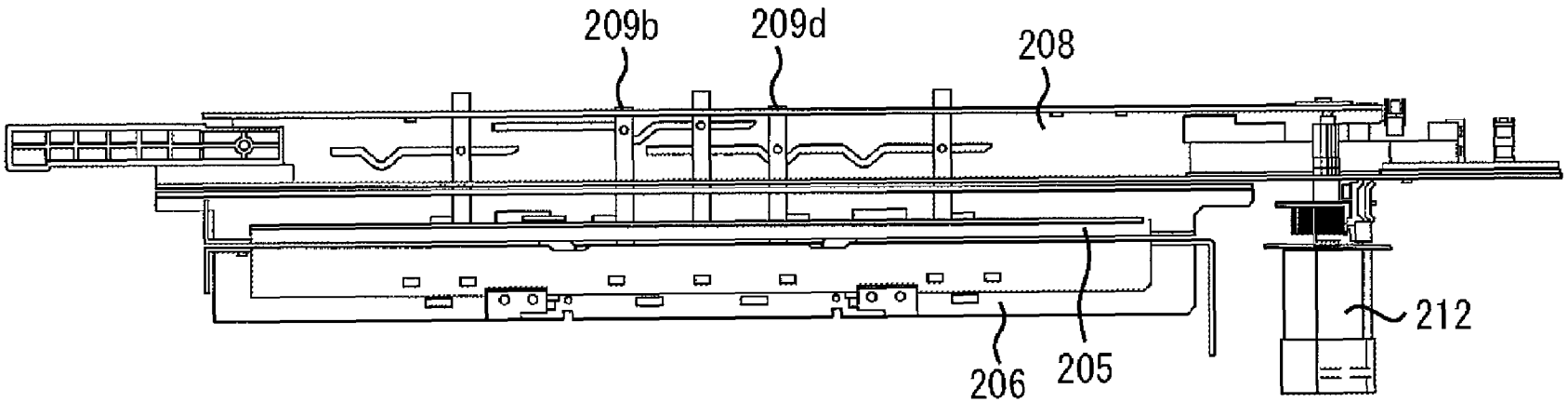
FIG. 7 illustrates a state where the punch unit illustrated in FIG. 5 opens two-hole type punch holes.

FIG. 7 illustrates a positional relationship between the slide rack 208 and the plurality of punches 209*a* to 209*e* in the punching operation for opening the two-hole type punch holes. In this case, two punches 209*b* and 209*d* (i.e., two punches dedicated to the formation of the two-hole type punch holes) are located at their lowest positions, which can be realized by the movement of the slide rack 208.

Figure 8:
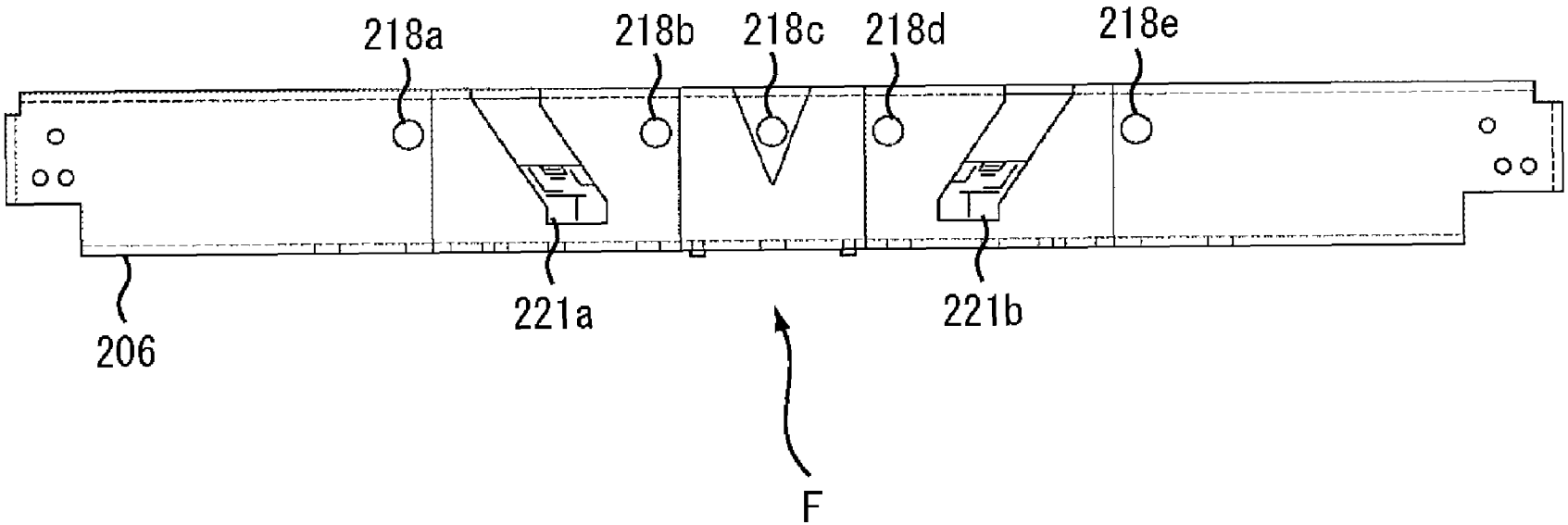
FIG. 8 illustrates the punch unit seen from a direction indicated by an arrow A illustrated in FIG. 5.
Figure 9:
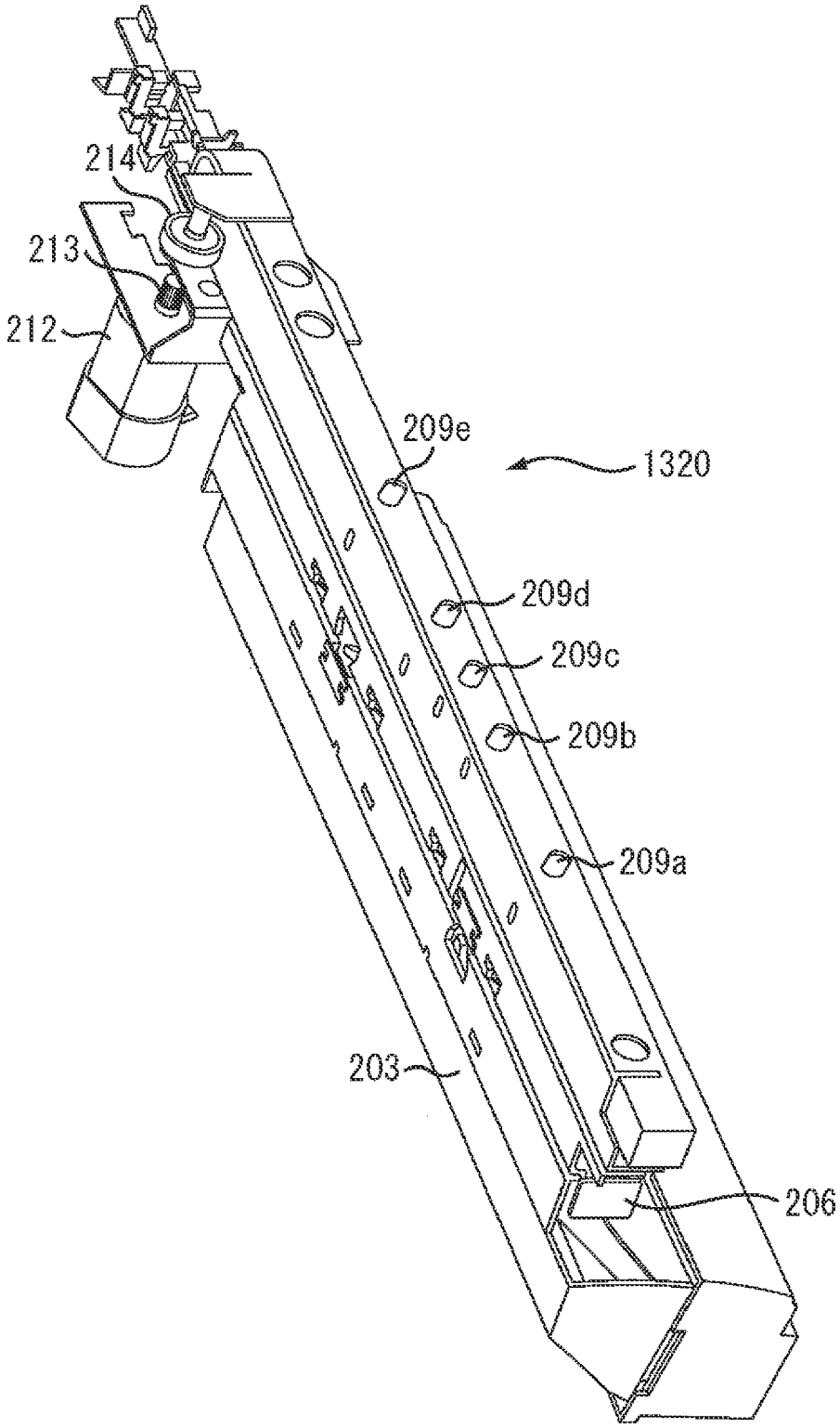
FIG. 9 illustrates a perspective view of the punch unit.

FIG. 8 illustrates a plan view of the die 206. The punch holes opened on the die 206 are the die hole portions 218*b* and 218*d* dedicated to the formation of the two-hole type punch holes and the die hole portions 218*a*, 218*c*, and 218*e* dedicated to the formation of the three-hole type punch holes. When the punch unit 1320 performs the punching operation for opening the two-hole type punch holes, two punches 209*b* and 209*d* enter into the die hole portions 218*b* and 218*d* of the die 206 in the state illustrated in FIG. 7. Two punch holes can be formed on a sheet P. The punch scrap, if generated by the punching operation, falls off the die hole portions 218*b* and 218*d* and can be received by a punch scrap box 203 illustrated in FIG. 9.

Figure 10:
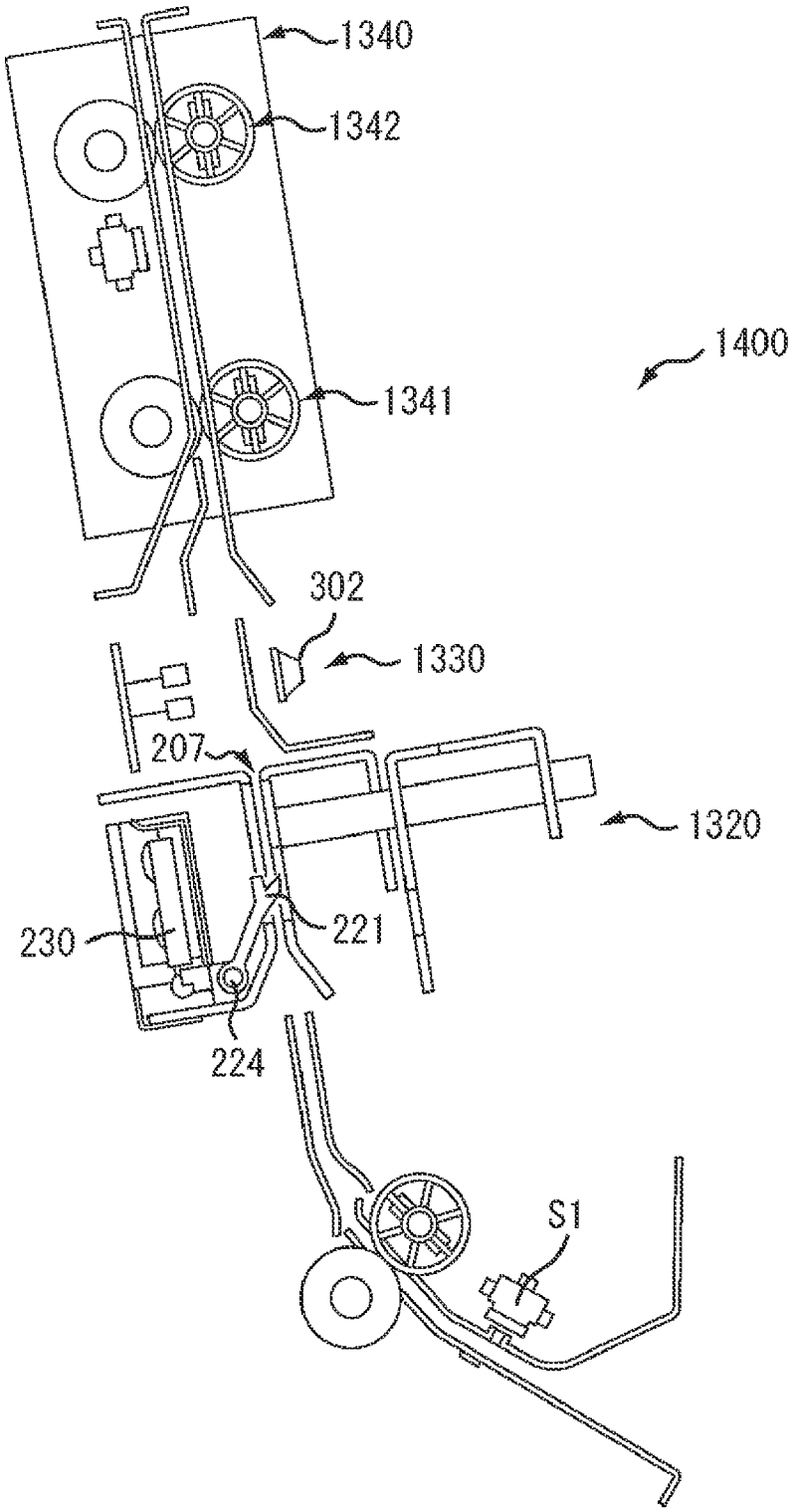
FIG. 10 is a cross-sectional view illustrating a positional relationship of the punch unit illustrated in FIG. 5 in the formation of the two-hole type punch holes.

As illustrated in FIG. 6, FIG. 8, or FIG. 10, a rear edge stopper 221 (221*a*, 221*b*) is provided at the upstream side of the die hole portions 218*a* to 218*e* in the sheet conveyance direction. The rear edge stopper 221 (221*a*, 221*b*) protrudes toward the conveyance path 207.

After the upstream edge of a sheet in the sheet conveyance direction has once passed through the punching unit constituted by the punch 209 and the die 206, the sheet is moved backward. The rear edge stopper 221 can abut a downstream edge of the sheet in a sheet returning direction, thereby maintaining a constant distance between the downstream edge of the sheet in the sheet returning direction and the die hole.

A spring 230 illustrated in FIG. 10 resiliently urges the rear edge stopper 221 that can serve as a sheet abutting member as described above. The rear edge stopper 221 can swing around a rotary fulcrum shaft 224 and can protrude into the conveyance path 207. According to this arrangement, the rear edge stopper 221 is positioned on the upstream side of the punching unit in the sheet conveyance direction. Thus, the sheet can be stopped and held at a punching position where the punching unit performs the punching processing.

When the sheet P is conveyed in a direction indicated by an arrow F illustrated in FIG. 6, the rear edge stopper 221 is pressed by the sheet P and rotates (i.e., retracts) in a direction indicated by an arrow G against a resilient force of the spring 230. When the upstream edge of the sheet P in the sheet conveyance direction has passed through the rear edge stopper 221, the spring 230 returns the rear edge stopper 221 to the original position (i.e., home position).

In this state, i.e., after the rear edge stopper 221 is returned to the original position, two conveyance roller pairs 1341 and 1342 cause the sheet P to switch back, and then, the upstream edge of the sheet in the sheet conveyance direction (i.e., the downstream edge of the sheet in the sheet returning direction) abuts an abutting portion 225 of the rear edge stopper 221.

An inlet sensor S1 illustrated in FIG. 10 can detect a sheet discharged from the copying machine main body 1000. The ON/OFF signal of the inlet sensor S1 can be used to control the switchback motion of the sheet P performed by the conveyance roller pairs 1341 and 1342.

FIG. 11 is a block diagram illustrating a control system of the copying machine 1100. The CPU circuit unit 850 includes a CPU 849, a read only memory (ROM) 851 that can store control programs, and a random access memory (RAM) 870 that can be used as an area where control data are temporarily stored or can be used as a work area for calculations.

An external interface 857 illustrated in FIG. 11 is an interface that controls data communications performed between the copying machine 1100 and an external PC (i.e., a computer) 820. More specifically, the external interface 857 receives print data from the external PC 820 and rasterizes the received print data into a bitmap image. Then, the external interface 857 outputs the bitmap image data to an image signal control portion 854.

The image signal control portion 854 outputs the bitmap image data to a printer control portion 855. The printer control portion 855 outputs the bitmap image data received from the image signal control portion 854 to an exposure control portion (not illustrated). An image reader control portion 853 receives a document image read by the image sensor 1211 (see FIG. 1) and outputs the received document image to the image signal control portion 854. The image signal control portion 854 outputs an image output signal to the printer control portion 855.

The operation portion 1040 includes a plurality of keys that can be operated to set various functions relating to the image forming and a display unit configured to display a setting state. The operation portion 1040 outputs a key signal representing a key operation by a user to the CPU circuit unit 850. The operation portion 1040 displays corresponding information on the display unit based on a signal received from the CPU circuit unit 850.

The CPU circuit unit 850 controls the image signal control portion 854 according to the control program stored in the ROM 851 and the settings entered via the operation portion 1040. The CPU circuit unit 850 further controls the document conveyance apparatus 1210 (see FIG. 1) via a document conveyance apparatus control portion 852.

Moreover, the CPU circuit unit 850 controls the document reading portion 1200 (see FIG. 1) via the image reader control portion 853. The CPU circuit unit 850 controls the image forming portion 1020 (see FIG. 1) via the printer control portion 855. The CPU circuit unit 850 controls the finisher 1500 via the finisher control portion 856.

In the present exemplary embodiment, the finisher control portion 856 is installed on the finisher 1500. The finisher control portion 856 performs a driving control for the finisher 1500 based on data communication with the CPU circuit unit 850. As another example of the present exemplary embodiment, the finisher control portion 856 can be integrated with the CPU circuit unit 850 and can be provided in the copying machine main body 1000. In this case, the finisher control portion 856 installed on the copying machine main body 1000 can directly control the finisher 1500.

The finisher control portion 856 includes a CPU (microcomputer) 900, a random access memory (RAM) 901, a read only memory (ROM) 902, an input/output portion (I/O) 903, a communication interface 905, and a network interface 904.

The finisher control portion 856 can control a punching operation control portion 906 via the input/output portion (I/O) 903. The punching operation control portion 906 includes a lateral registration detection unit control portion 908. The lateral registration detection unit control portion 908 is connected to the lateral registration detection sensor 302, the inlet sensor S1, and the sensor motor 314. The lateral registration detection unit control portion 908 can control the lateral registration detection unit 1330.

The punching operation control portion 906 further includes a shift unit control portion 909 that is connected to the shift conveyance motor 417 and the shift motor 422. The shift unit control portion 909 can control the shift unit 1340. The punching operation control portion 906 further includes a punch unit control portion 910 that is connected to the punch motor 212. The punch unit control portion 910 can control the punch unit 1320.

The finisher control portion 856 controls the punching operation control portion 906 (i.e., the lateral registration detection unit control portion 908, the shift unit control portion 909, and the punch unit control portion 910) when the punching processing is performed, so that a predetermined number of punch holes can be opened on sheets as intended.

The operation portion 1040 can serve as an input portion that enables users to input a sheet length in the width direction. The finisher control portion 856 selectively performs a control for changing a shifting amount of the sheet to be changed by the shift unit 1340 based on the information input via the operation portion 1040 (i.e., the information indicating the sheet length in the width direction).

Next, sequential operations in the punching processing to be performed by the punch unit 1320, the lateral registration detection unit 1330, and the shift unit 1340, which are controlled by the punching operation control portion 906, are described below in association with a sheet conveyance operation.

Figure 12A:
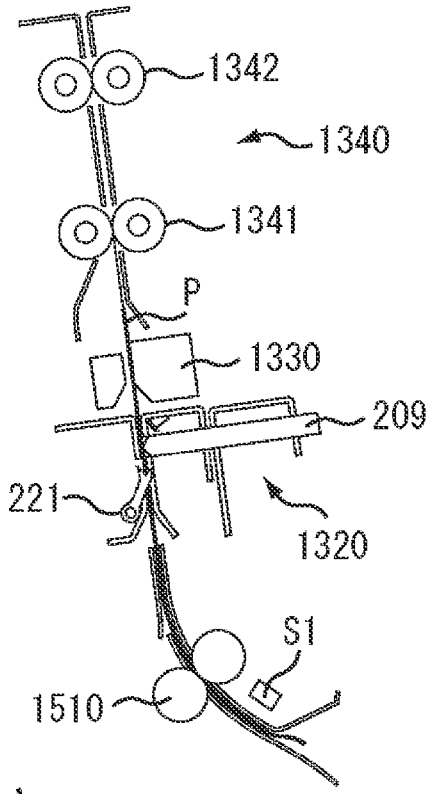
FIGS. 12A and 12B are the first diagram illustrating a punching processing operation that can be performed by the punching processing apparatus provided in the finisher illustrated in FIG. 2.

First, when the sheet P enters into the finisher 1500 after the sheet P is discharged from the copying machine main body 1000, the sheet P is detected by the inlet sensor S1. Subsequently, as illustrated in FIG. 12A, the sheet P is conveyed by the inlet roller pair 1510 while it is sandwiched between the rollers. Then, the sheet P reaches the punch unit 1320.

Next, the sheet P reaches the shift unit 1340 via the lateral registration detection unit 1330 while pressing the rear edge stopper 221 that protrudes toward the conveyance path R1 of the punch unit 1320.

As described above, when the sheet P passes through a stop position where the sheet P is stopped by the rear edge stopper 221 and the punching unit (i.e., the die hole) and reaches the lateral registration detection unit 1330, the lateral registration detection unit 1330 performs scanning in a front inner direction (i.e., the width direction). Thus, the lateral registration detection sensor 302 confirms (detects) the side edge position of the sheet P in the width direction.

After the side edge position of the sheet P in the width direction is confirmed as described above, the shift unit control portion 909 controls the shift motor 422 of the shift unit 1340 (see FIG. 4 and FIG. 11). The shift motor 422 moves the side edge position of the sheet P in the width direction to a predetermined thrust position that is shifted from the punching position of the punch unit 1320 by a predetermined amount.

In this case, if a user operates the operation portion 1040 to select a specific sheet (e.g., a sheet having a size of LTR_R or RGL_R) that requires the formation of the two-hole type punch holes, the shift motor 422 moves the side edge position of the sheet P excessively so as to exceed a predetermined edge portion position in the width direction (hereinafter, referred to as a "side edge position") by a constant distance (e.g., 6 mm).

More specifically, in the present exemplary embodiment, the shift motor 422 moves the side edge position of the sheet P by a distance that is 6 mm (i.e., the predetermined amount) longer than a shifting amount required to correct the side edge position of the sheet according to the side edge position of the sheet detected by the lateral registration detection sensor 302. The shift unit control portion 909 performs the above-described operations during a conveyance operation of the sheet P.

In the present exemplary embodiment, a punch hole to be formed has a diameter of 8 mm. The shift unit control portion 909 compares a predetermined punching position of the punch unit 1320 in the width direction with a selected sheet size. The shift unit control portion 909 performs the shifting control only when it is determined that the punch hole to be formed and a corner portion (i.e., the side edge position) of the sheet are in an overlapped relationship in their mutual position.

For example, in a case where the center of the punch hole coincides with the side edge position of the sheet, if the sheet is shifted by the above-described predetermined amount (i.e., 6 mm), the side edge position of the sheet can be shifted 2 mm from a peripheral edge of the punch hole because the radius of the punch hole is 4 mm.

Therefore, if the above-described predetermined amount is set to be equal to or greater than 6 mm, a rear edge corner portion of the sheet can be surely prevented from coinciding with the die hole portion. A detection result of the sheet side edge position obtained by the lateral registration detection sensor 302 can be used to improve the accuracy of the control.

As described above, when the sheet is shifted toward the peripheral edge of the punch hole adjacent to the side edge position of the sheet considering the actual side edge position of the sheet detected by the lateral registration detection sensor 302, the rear edge corner portion of the sheet can be surely prevented from being positioned in an overlapped relationship with the die hole portion.

Figure 12B:
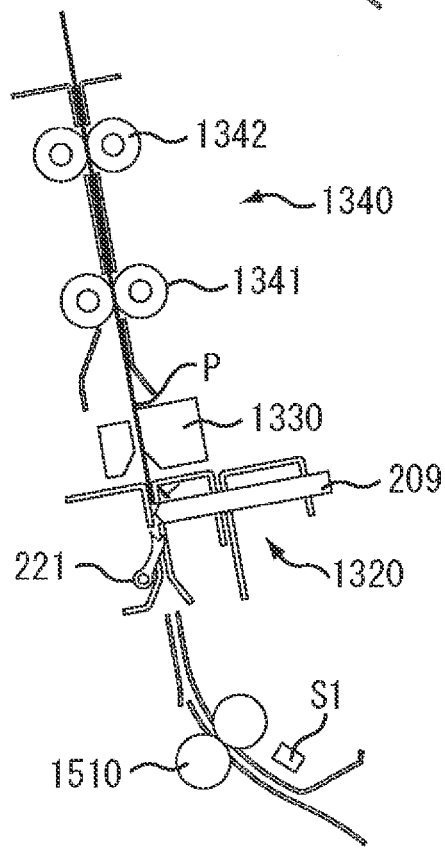

Next, as illustrated in FIG. 12B, when the upstream edge of the sheet P in the sheet conveyance direction has passed through the rear edge stopper 221, the rear edge stopper 221 returns to its original position while being resiliently urged by the spring 230.

Subsequently, the sheet is conveyed by a predetermined amount. At the timing when the upstream edge of the sheet P in the sheet conveyance direction has once passed through the die hole, the shift conveyance motor 417 (see FIG. 4 and FIG. 11) of the shift unit 1340 is controlled to stop the conveyance roller pairs 1341 and 1342. As described above, the shift conveyance motor 417 can rotate in both forward and backward directions.

Next, when the shift conveyance motor 417 starts rotating in the backward direction, the sheet P starts switching back. The stop and reverse rotation timing of the shift conveyance motor 417 (i.e., the conveyance roller pairs 1341 and 1342) is variable depending on a conveyance length of the sheet P. However, the punching operation control portion 906 can control the stop and reverse rotation timing of the shift conveyance motor 417 based on a sheet detection signal of the inlet sensor S1.

Figure 13A:
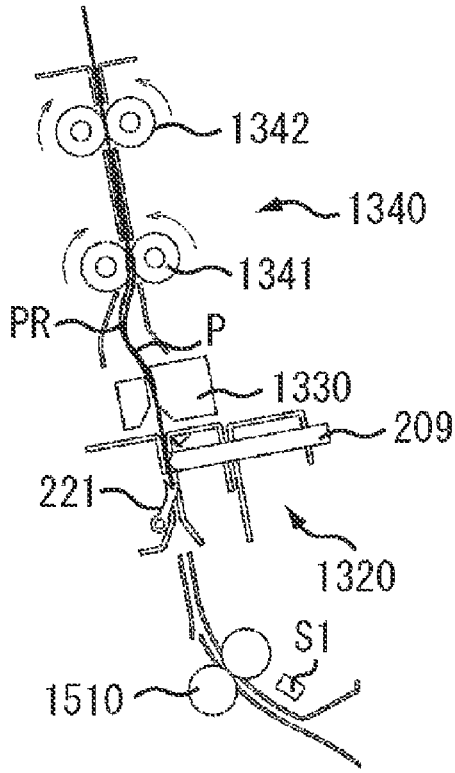
FIGS. 13A and 13B are the second diagram illustrating the punching processing operation that can be performed by the punching processing apparatus provided in the finisher illustrated in FIG. 2.

Next, in a state where the conveyance roller pairs 1341 and 1342 continuously convey the sheet P in the backward direction, the upstream edge of the sheet P in the sheet conveyance direction abuts the rear edge stopper 221 and the sheet P forms a predetermined loop PR as illustrated in FIG. 13A. In a state where the sheet P is kept in the loop PR shape, the orientation of the sheet P can be corrected if the sheet P includes any skew.

Next, in a state where the skew of the sheet P is corrected as described above after the sheet P has abutted the rear edge stopper 221, the shift motor 422 (see FIG. 4) is activated to move the sheet P in the width direction until the sheet P reaches a position that coincides with the punching position of the punch unit 1320.

In this case, the sheet P is already shifted by the distance that is 6 mm (i.e., the predetermined distance X) longer than the shifting amount required to correct the side edge position of the sheet in the first sheet moving operation. Therefore, in the second sheet moving operation, the sheet P is moved backward by the predetermined distance X to set the punching position of the punch unit 1320 to a correct position relative to the sheet P.

Figure 13B:
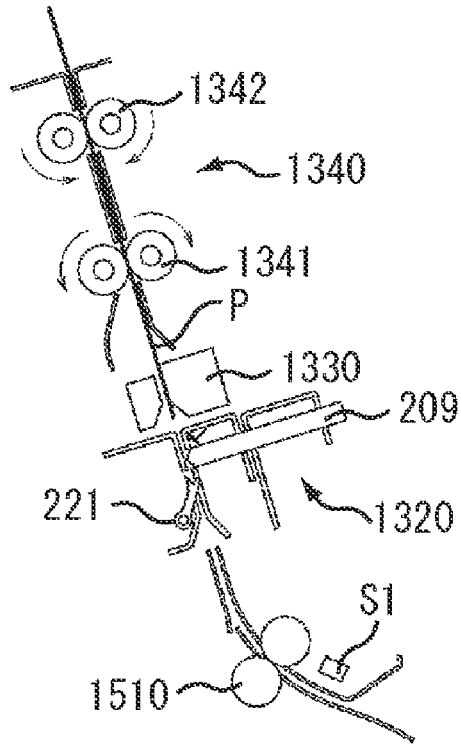

Next, the punch motor 212 (see FIG. 6 and FIG. 11) is activated to drive the punch 209. The punch 209 performs punching processing on the sheet P. Subsequently, the shift conveyance motor 417 rotates in the forward direction. The conveyance roller pairs 1341 and 1342 rotate in the forward direction. Therefore, the sheet P is conveyed as illustrated in FIG. 13B.

Figure 14:
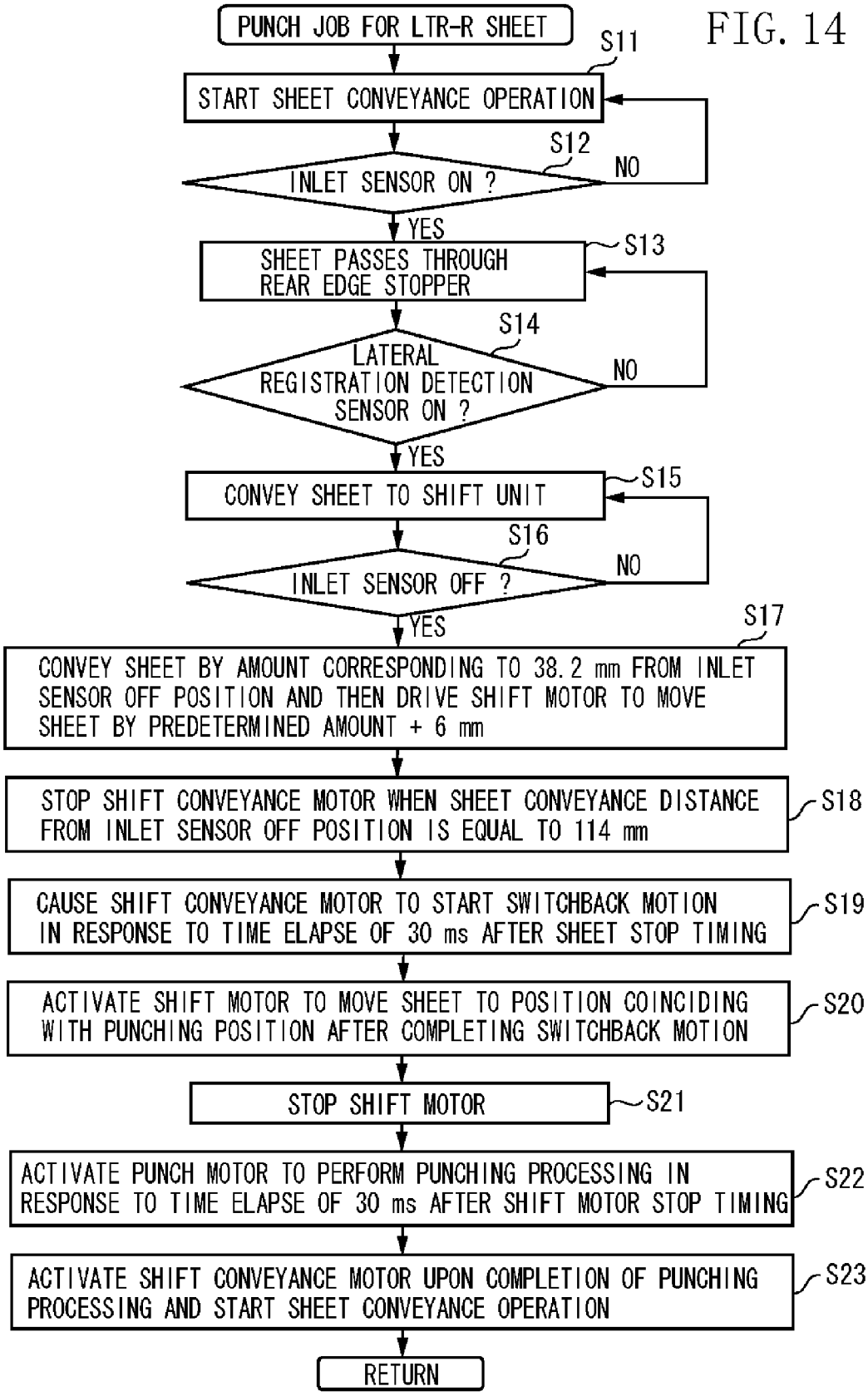
FIG. 14 is a flowchart illustrating an example of the punching processing operation that can be performed by the punching processing apparatus provided in the finisher illustrated in FIG. 2.
Figure 15:
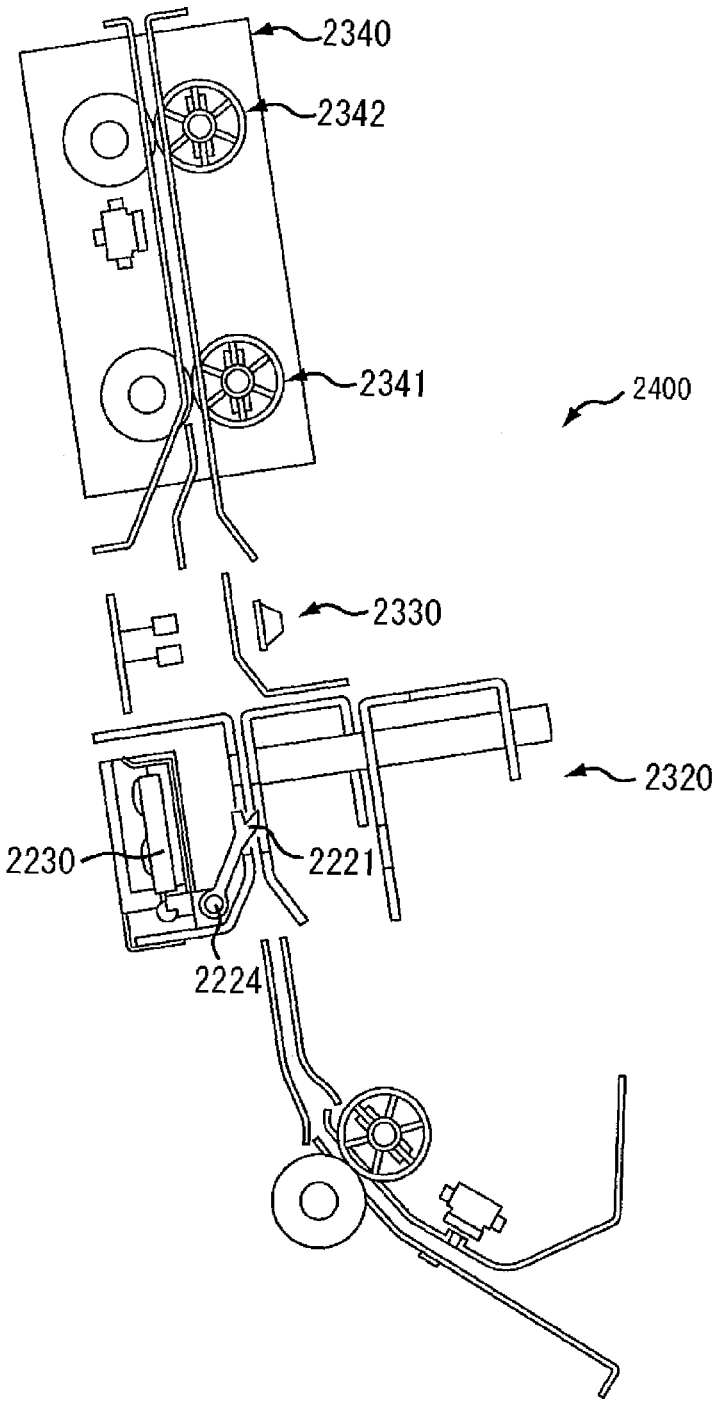
FIG. 15 PRIOR ART
FIG. 15 illustrates a configuration of a conventional sheet processing apparatus.
Figure 16:
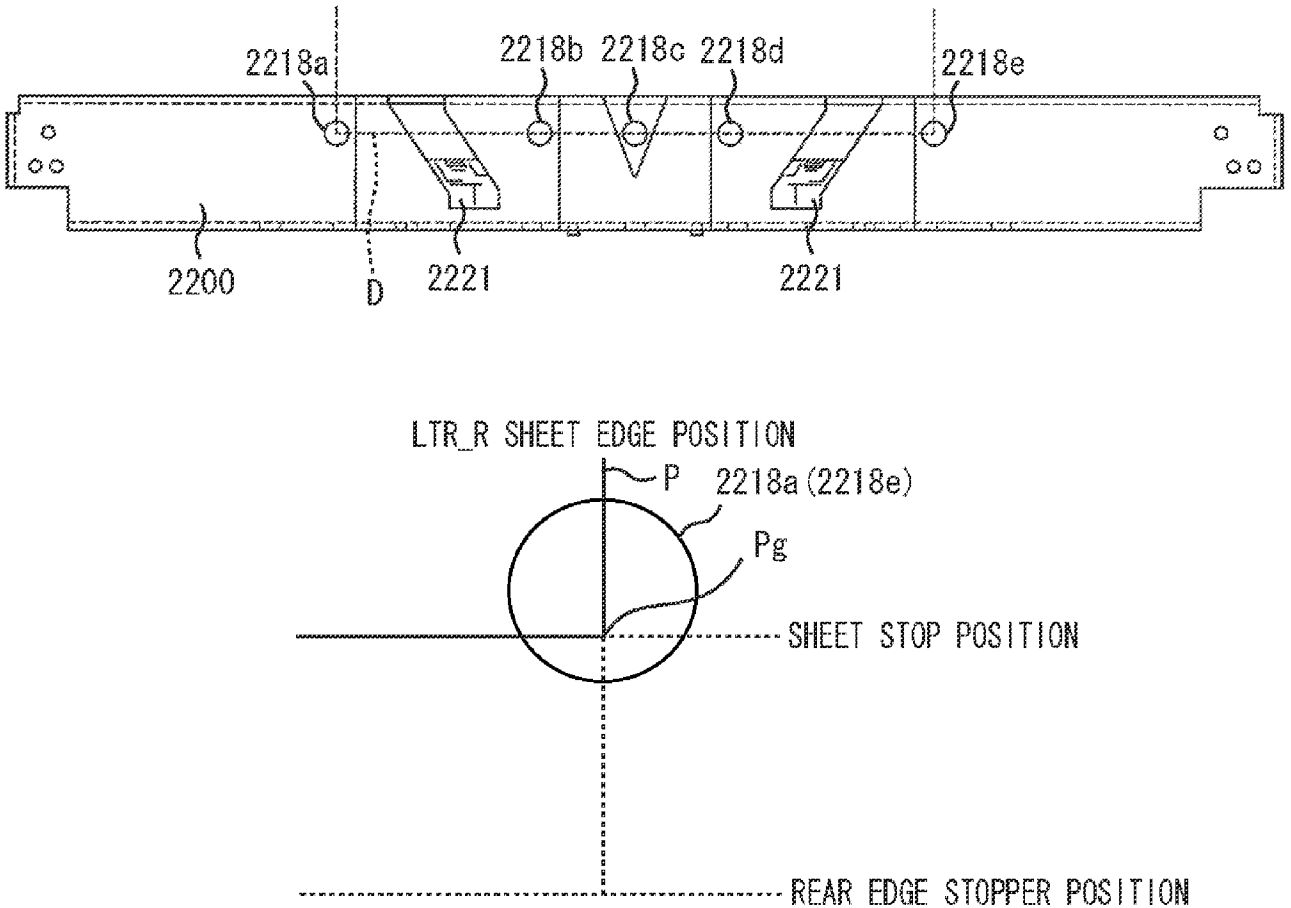
FIG. 16 PRIOR ART
FIG. 16 illustrates a die that can be used for a punch unit of the conventional sheet processing apparatus.

FIG. 14 is a flowchart illustrating an example of the punching processing to be performed according to the present exemplary embodiment. More specifically, the punching processing described below with reference to the flowchart illustrated in FIG. 14 is processing to be performed when a mode for performing the punching processing on the sheet having the size of LTR_R or LGL is selected by a user.

First, in step S11, the punching operation control portion 906 starts the sheet conveyance operation upon starting a job. In step S12, the punching operation control portion 906 determines whether the inlet sensor S1 is turned on when a sheet passes through the inlet sensor S1. If it is determined that the inlet sensor S1 is in an ON state (YES in step S12), the punching operation control portion 906 confirms that the sheet has entered the finisher 1500.

Next, in step S13, the sheet passes through the rear edge stopper. The sheet is then conveyed to the lateral registration detection unit 1330 as illustrated in FIG. 12A.

In step S14, the punching operation control portion 906 determines whether the lateral registration detection sensor 302 is turned on in response to a detection of the sheet edge portion. If it is determined that the lateral registration detection sensor 302 is in an ON state (YES in step S14), the punching operation control portion 906 changes a shifting amount of the sheet to be moved by the shift unit 1340 in the width direction based on the detection result.

Next, in step S15, the sheet is conveyed to the shift unit 1340. Subsequently, the upstream edge of the sheet in the sheet conveyance direction passes through the inlet sensor S1. At this moment, the inlet sensor S1 is turned off. If it is determined that the inlet sensor S1 is in an OFF state (YES in step S16), the processing proceeds to step S17. In step S17, the sheet is further conveyed by a predetermined distance that is equal to 38.2 mm in the present exemplary embodiment. As a result, the upstream edge of the sheet P in the sheet conveyance direction passes away from the rear edge stopper 221 as illustrated in FIG. 12B. The rear edge stopper 221 returns to its original position while being resiliently urged by the spring 230.

Then, the punching operation control portion 906 drives the shift motor to move the sheet by an amount determined based on the detection result in the above-described step S14. The moving amount in this case includes the above-described predetermined distance X (i.e., +6 mm).

Next, in step S18, the punching operation control portion 906 stops the shift conveyance motor 417 at the timing when the sheet conveyance distance from the inlet sensor S1 OFF position reaches 114 mm. Further, in step S19, in response to elapse time of 30 ms after the sheet stop timing, the punching operation control portion 906 causes the shift conveyance motor 417 to start rotating in the reverse direction, thereby causing the sheet to start switching back.

Therefore, as illustrated in FIG. 13A, the upstream edge of the sheet P in the sheet conveyance direction abuts the rear edge stopper 221 and the sheet P forms the predetermined loop PR. While the sheet P is kept in the loop PR shape, the orientation of the sheet P can be corrected if the sheet P includes any skew.

In step S20, the punching operation control portion 906 activates the shift motor 422 in response to the abutment of the sheet P to the rear edge stopper 221. The shift motor 422 moves the sheet P by the predetermined distance (i.e., 6 mm) in the direction opposed to the direction in the above-described step S17. Namely, the shift motor 422 moves the sheet to the position that coincides with the punching position of the punch unit 1320. Subsequently, in step S21, the punching operation control portion 906 stops the shift motor upon completion of the operation for moving the sheet to the punching position.

Next, in step S22, the punching operation control portion 906 activates the punch motor to perform punching processing in response to elapse time of 30 ms after the operation stop timing of the shift motor. Then, in step S23, the punching operation control portion 906 activates the shift conveyance motor 417 upon completing the punching processing to start conveying the sheet toward the downstream side.

As described above, the sheet processing apparatus according to the present exemplary embodiment sets the shifting amount of a sheet shifted in the width direction after the downstream edge of the sheet in the sheet conveyance direction has passed through the die hole, to an excessive value increased by a predetermined amount. The sheet processing apparatus according to the present exemplary embodiment moves the sheet in the backward direction by an amount corresponding to the above-described increased predetermined amount, before sheet processing apparatus starts the punching processing.

More specifically, in the operation for correcting the side edge position of the sheet, the sheet processing apparatus according to the present exemplary embodiment sets the sheet shifting amount to a value that is a predetermined amount greater than a shifting amount required to correct the sheet side edge position.

Then, after the downstream edge of the sheet in the sheet conveyance direction has passed through the die hole in the movement returning to the punching position, the sheet processing apparatus according to the present exemplary embodiment moves the sheet backward by the predetermined amount to return the shifting amount to the required value.

Through the above-described operations, in a case where a sheet having a sheet size requiring the formation of the two-hole type punch holes is switched back, the sheet processing apparatus according to the present exemplary embodiment can surely prevent a rear edge corner portion of the sheet from being positioned in an overlapped relationship with the die hole portions dedicated to the three-hole type punch holes.

Thus, the sheet processing apparatus according to the present exemplary embodiment can improve the position accuracy in the formation of the punch holes. Further, in accordance with the improvement of position accuracy in the formation of the punch holes, the sheet processing apparatus according to the present exemplary embodiment can improve the quality of each product that can be obtained by binding the sheets having been subjected to punching processing.

The sheet processing apparatus according to the above-described exemplary embodiment is configured to cause a sheet to switch back when the punch hole is formed. However, the sheet processing apparatus according to the present invention is not limited to the above-described configuration. For example, the present invention can be applied to another sheet processing apparatus that is configured to directly convey a sheet to the punching position without causing the sheet to switch back.

When the present invention is applied to another sheet processing apparatus having the above-described configuration, the shifting unit can be disposed on the upstream side of the punching unit in the sheet conveyance direction. In this case, the shifting unit shifts a conveyed sheet in the width direction by the predetermined amount, which is determined beforehand to prevent an edge portion of the conveyed sheet from being positioned in an overlapped relationship with the die hole.

After the downstream edge of the conveyed sheet in the sheet conveyance direction has passed through the die hole, the sheet processing apparatus moves the sheet backward in the width direction by the predetermined amount. Therefore, the sheet processing apparatus according to the above-described embodiment can obtain similar effects.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application Nos. 2009-018821 filed Jan. 29, 2009, and 2009-284855 filed Dec. 16, 2009, which are hereby incorporated by reference herein in their entirety.

What is claimed is:

1. A sheet processing apparatus, comprising:

a sheet conveyance portion configured to convey a sheet to a sheet abutting member against which an edge in a sheet conveyance direction of the sheet is abutted;

a punching unit including a plurality of punches arranged in a width direction perpendicular to the sheet conveyance direction and die holes that are cooperative with the plurality of punches to perform punching processing on the sheet, the edge of which passes through the die holes and is abutted against the sheet abutting member;

a shifting unit configured to move the sheet in the width direction; and a control portion configured to control the shifting unit based on information indicating a sheet length in the width direction of the sheet to be conveyed to the sheet abutting member so that the shifting unit moves the sheet in the width direction by a predetermined amount that is set so as not to overlap a corner portion of the sheet with any of the die holes.

2. The sheet processing apparatus according to claim 1, wherein the plurality of punches and the corresponding die holes are arranged in the width direction according to two or more types of punch holes which are mutually different in interval between the holes and number of the holes.

3. The sheet processing apparatus according to claim 1, wherein the shifting unit is configured to move the sheet backward in the width direction by the predetermined amount, after a downstream edge of the sheet being conveyed in the sheet conveyance direction by the sheet conveyance portion has passed through the die hole.

4. The sheet processing apparatus according to claim 1, further comprising:

a detection unit configured to detect a side edge position of the conveyed sheet in the width direction, wherein when the side edge position of the sheet is corrected based on a detection result obtained by the detection unit, a shifting amount of the sheet moved by the shifting unit is set to a value that is greater than a required shifting amount required to correct the side edge position of the sheet by the predetermined amount, and the shifting unit is configured to move the sheet backward to a position corresponding to the required shifting amount after a downstream edge of the sheet conveyed in the sheet conveyance direction by the sheet conveyance portion has passed through the die hole.

5. The sheet processing apparatus according to claim 1, wherein the sheet conveyance portion conveys the sheet until the upstream edge of the sheet in the sheet conveyance direction once passes through the die hole in the punching processing, and moves the sheet backward to the sheet abutting member.

6. The sheet processing apparatus according to claim 5, wherein the downstream edge of the sheet in a sheet returning direction is abutted against the sheet abutting member when the sheet is moved backward to the position where the sheet covers the die hole, so as to maintain a constant distance between the downstream edge of the sheet in the sheet returning direction and the die hole, wherein a skew of the sheet is corrected by causing the downstream edge of the sheet to abut the sheet abutting member when the sheet is moved backward to the position where the sheet covers the die hole, before the punching unit starts the punching processing.

7. The sheet processing apparatus according to claim 6, wherein the sheet abutting member is pressed by the sheet when the sheet once passes through the die hole and the sheet abutting member retracts from the sheet conveyance path.

8. An image forming apparatus, comprising:

an image forming portion configured to form an image on a sheet;

a sheet processing apparatus that performs processing on the sheet after the image is formed on the sheet by the image forming portion; and a control portion configured to control the sheet processing apparatus, wherein the sheet processing apparatus, comprising:

a sheet conveyance portion configured to convey the sheet to a sheet abutting member against which an edge in a sheet conveyance direction of the sheet is abutted;

a punching unit including a plurality of punches arranged in a width direction perpendicular to the sheet conveyance direction and die holes that are cooperative with the plurality of punches to perform punching processing on the sheet, the edge of which passes through the die holes and is abutted against the sheet abutting member; and a shifting unit configured to move the sheet in the width direction, wherein the control portion controls the shifting unit based on information indicating a sheet length in the width direction of the sheet to be conveyed to the sheet abutting member so that the shifting unit moves the conveyed sheet in the width direction by a predetermined amount that is set so as not to overlap a corner portion of the sheet with any of the die holes.

9. The image forming apparatus according to claim 8, further comprising:

an input portion configured to input the information indicating the sheet length in the width direction of the sheet to be processed, wherein the predetermined amount to be moved by the shifting unit is changed according to the information indicating the sheet length in the width direction input by the input portion.

* * * * *